United States Patent [19]

Schulze

[11] Patent Number: 4,633,759

[45] Date of Patent: Jan. 6, 1987

[54] HYDRAULIC PIVOT DRIVE

[75] Inventor: Eckehart Schulze, Weissach, Fed. Rep. of Germany

[73] Assignee: Hartmann & Lammle GmbH & Co., Rutesheim, Fed. Rep. of Germany

[21] Appl. No.: 771,721

[22] Filed: Sep. 3, 1985

Related U.S. Application Data

[63] Continuation of Ser. No. 463,661, Feb. 5, 1983.

[30] Foreign Application Priority Data

Feb. 6, 1982 [DE] Fed. Rep. of Germany ..... 3204067

[51] Int. Cl.[4] ..... F15B 9/10

[52] U.S. Cl. ..... 91/368; 91/380; 91/457; 92/121

[58] Field of Search ..... 91/368, 380, 382, 454, 91/457, 266; 92/121

[56] References Cited

U.S. PATENT DOCUMENTS

| | | | |
|---|---|---|---|
| 1,665,966 | 4/1928 | Kupka | 91/457 |
| 2,910,967 | 11/1959 | Rosebrook | 91/380 |
| 3,269,737 | 8/1966 | Freese | 92/121 |
| 3,310,284 | 3/1967 | Seiuemoninaba et al. | 91/380 |
| 3,381,712 | 5/1968 | Wittren et al. | 91/380 |
| 3,457,836 | 7/1969 | Henderson | 91/368 |
| 3,680,982 | 8/1972 | Jacobellis | 92/121 |
| 4,369,693 | 1/1983 | Schulze | 91/382 |

FOREIGN PATENT DOCUMENTS

| | | | |
|---|---|---|---|
| 2156695 | 5/1973 | Fed. Rep. of Germany | 91/457 |

*Primary Examiner*—Robert E. Garrett
*Assistant Examiner*—John Kwon
*Attorney, Agent, or Firm*—Antonelli, Terry & Wands

[57] ABSTRACT

A hydraulic pivot drive comprising a rotary-piston hydraulic cylinder and control device for maintaining the pressure difference between pressure chambers defined by the rotary vane and at least one radial wall of the cylinder housing required for maintaining a defined relative rotary position between the vane and the housing of the rotary piston hydraulic cylinder. The control a follow-up control valve, wherein the actual condition relative to the pivot angle is fed back via a measuring spindle coupled with the rotating part of the rotary piston hydraulic cylinder and the desired value is preset by rotation of a spindle nut engaging the spindle, an actuating member arranged for axial displacement together with the spindle nut and for actuating pairs of seat valves for enabling alternative connection of the at least two pressure chambers of the rotary-piston hydraulic cylinder with a system to obtain the desired rotation.

1 Claim, 5 Drawing Figures

HYDRAULIC PIVOT DRIVE

This is a continuation of Application Ser. No. 463,661 filed Feb. 5, 1983.

The present invention relates to a hydraulic pivot drive having a rotary-piston motor comprising at least two working pressure chambers separated by a vane, which chambers can be alternatively connected to the high-pressure side or low-pressure side of the hydraulic pressure-supply system.

It is a characteristic feature of such pivot drives that for a given design drive power and/or force the overall dimensions required are considerably smaller than, for example, those necessary for linear motors. Further it is of advantage that the pivot angle which may be as great as 320° with rotating-piston hydraulic cylinders, is notably greater than the pivot angle of a pivot drive designed, for example, as link drive using a linear motor of variable length as link—in this case, the pivot angle maximally obtainable is clearly smaller than 180°—and that the full hydraulic force, viewed in the pivoting direction, can be used in any rotary position and sense of rotation of the vane of the rotary-piston hydraulic cylinder.

In practice, however, the following disadvantages accompanied with rotary-piston hydraulic cylinders reduce their universal applicability in hydraulic pivot drives:

Due to the relatively small length of the gap remaining between the vane and the cylinder housing, measured between the two working pressure chambers of the rotary-piston hydraulic cylinder in the sense of rotation of the vane, which length has a material influence on the leakage losses in the sense of a reciprocal interrelationship, the leakage losses encountered in rotary-piston hydraulic cylinders are generally considerably higher than, for example, in linear motors where the piston can be given a sufficiently great length to obtain a sufficiently high flow resistance of the gap remaining between the pressure chambers to minimize the leakage losses in a suitable manner.

In cases where the rotating part must be stopped in a defined position within the possible pivot range and then maintained in this position, the hydraulic pivot drives are, therefore, as a rule, designed as link drives with a hydraulic linear motor acting as link of variable length.

To limit the above-mentioned leakage losses in rotary-piston hydraulic cylinders to the lowest possible values, it has been suggested in German Utility Patent No. G 81 14 452.0 to arrange the rotating vanes between flanges on the power take-off shaft of the rotary-piston hydraulic cylinder and to seal the flanges against the cylinder housing by means of annular piston packings whereby the active width of the gap determining the leakage loss is reduced to the actual expansion of the rotary vane measured between the said flanges, and to simultaneously restrict the gap measured between the rotating vane and the cylinder housing to very small values, making use of the possibilities of extreme production accuracy to thereby keep the flow resistance of the gap as high as possible for a given gap length. By these measures, it is certainly possible to reduce the leakage loss to a value which ensures that the pivoting vane and, thus, a machine part coupled to its shaft can be held with satisfactory accuracy in a defined position within its pivot range, but the piston packing introduces into a pivot drive system an increased static friction as a result of which stick-slip effects are encountered, in particular in the starting and slowing-down phases of a pivoting motion when the circumferential speed in the gap area drops below the value above which the—as compared to the static friction—smaller sliding friction determines the resistance which has to be overcome by the rotary piston. Further, the rotary piston does not, as a result of the above situation accelerate and stop smoothly in a predetermined final position, but approaches the same by jerks and comes to a stop generally in a position which does not exactly conform with the pre-determined desired end position. It is not possible to overcome this difficulty by providing control means intended to pick up the actual position of the piston, compare it with the desired position and reset the rotary piston to its desired position, as such control means would, because of the stick-slip effect, lead to oppositely directed resetting motions of the rotary piston which would sort of build up near the desired end position so that the piston would not definitely stop in the desired position but rather perform vibratory movements at about the control frequency of the control means, a condition which cannot be accepted in practice.

So, the previously known pivot drives are as a rule not suited for applications in which it is essential that the pivot drive can assume a defined angular position against the action of a restoring force determined by a load, and maintain this position with a high degree of accuracy.

Another disadvantage of known hydraulic pivot drives which comprise packings such as the above-mentioned piston packings, is to be seen in the fact that they are subject to considerable wear so that their functional conditions must be continuously checked which gives rise to considerable maintenance costs.

Accordingly, it is the object of the present invention to provide a pivot drive of the type described above which while reliably avoiding stick-slip effects permits exact setting of a given pivot angle of the rotating vane and, thus, a machine element coupled with it, is largely wear resistant and maintenance-free and yet of simple and space-saving design.

In accordance with advantageous features of the present invention, a hydraulic pivot drive is provided having a rotary piston hydraulic cylinder which includes at least two pressure chambers defined by a vane and a radial wall of the cylinder housing and which can be alternatively connected to the high pressure and low pressure sides of a hydraulic pressure supply system. Control means are provided for leveling out a leak oil loss encountered in a defined rotary position of the vane with a width of gaps remaining between the vane and one of a wall of a cylinder housing or a shaft of the drive and a radial partition wall of the cylinder housing being determined in accordance with a predetermined relationship.

By virtue of the above noted features of the present invention, the pressure difference between the pressure chambers of the rotary-piston hydraulic cylinder defined by the rotary vane, which must be maintained for a given rotary position is maintained by suitable control means, and the height of the gap is selected—in line with the maximum control frequency of the control means—as great as possible within a safety margin determined by the control frequency of the control means.

It is true that this means putting up with quite a considerable flow of leakage oil from the high-pressure chamber to the low-pressure chamber and from the latter to the tank. The volume of this flow, related to the time unit, may be in the range of the chamber volume, but this is of no importance insofar as the high-pressure pump must anyway operate continuously. In exchange, at least the following decisive advantages are achieved for a rotary drive unit of usual size:

Because of the greater gap width, as compared to the known rotary drive, the production tolerances of the rotary-piston hydraulic cylinder and, thus, its production demands and expenses are drastically reduced. The fact that this design needs no packing flanges and piston packings, simplifies the construction of the rotary-piston hydraulic cylinder. Any stick-slip effects connected with static friction are completely avoided and considering that the frictional resistance is accounted for only by sliding resistance effects, it is possible to give the rotary-piston hydraulic cylinder a design practically free from frictional losses. This increases the possible service life drastically. Altogether, the invention describes a rotary-piston hydraulic cylinder which, in combination with suitable control means, finally makes it possible to use a rotary-piston hydraulic cylinder for position stabilizing purposes and/or as positioning drive.

Generally, all types of controls capable of stabilizing a rotary position in the desired manner are suited to be used in connection with the invention.

It is, however, desirable that the control frequency of a control intended to be used in combination with the rotary-piston hydraulic cylinder be as high as possible.

In accordance with further features of the present invention, the control means is constituted as a mechanical-hydraulic analog controller which offers the advantage of a control frequency which is by abt. the factor five higher than that of electronic-hydraulic controls.

The analog controller may, for example, comprise a conventional follow-up control valve having a spindle drive for presetting a nominal value and a feedback of the actual value, with the nominal value of the pivot angle of the vane being adjustable by rotating the spindle by, for example, a stepping motor.

The control frequency is, in accordance with the present invention, at least $500s^{-1}$, with the vane and partition wall of the housing having a sector-shape cross section with a sector angle of 30° and 60°, respectively. A diameter of the vane shaft is equal to half a clear diameter of the cylinder housing and both radial and axial extensions of the vane are 18–20 mm. A width of the axial and radially extending gaps between the housing and the vane are identical and substantially equal to 0.05 mm. A control means having these features with a specific design and size of the rotary-piston hydraulic cylinder which provides an advantageously small—maximally abt. 0.5°—angular deviation of the vane of the rotary-piston hydraulic cylinder from a given desired position, and which allows, on the one hand to adapt the dimensions to given marginal conditions and, on the other hand, to provide for a simple design taking into account manufacturing aspects.

Other details and features of the invention are apparent from the following description of one particular example and the drawing in which.

Figure 3A:
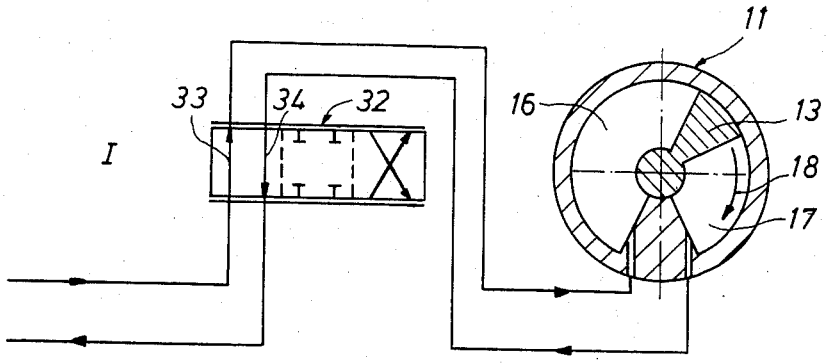
Figure 3B:
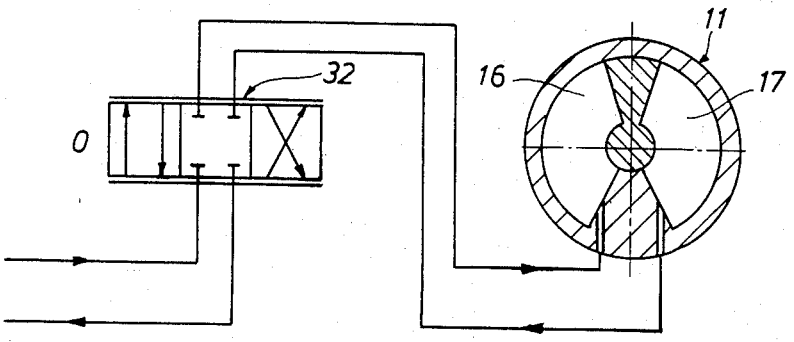
Figure 3C:
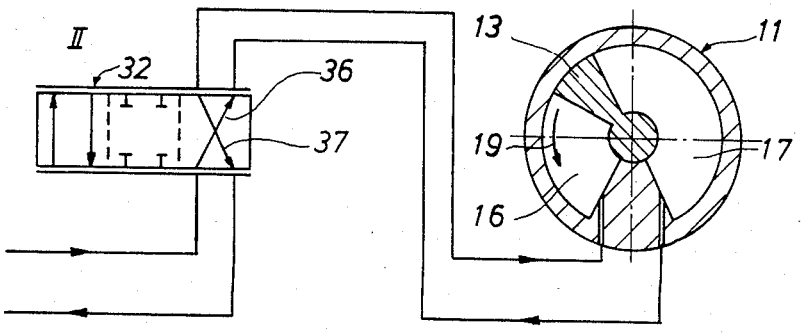

FIGS. 3*a* to 3*c* are schematic views, on an enlarged scale of different operating conditions of the pivot drive, which are meant to explain its function.

Figure 1:
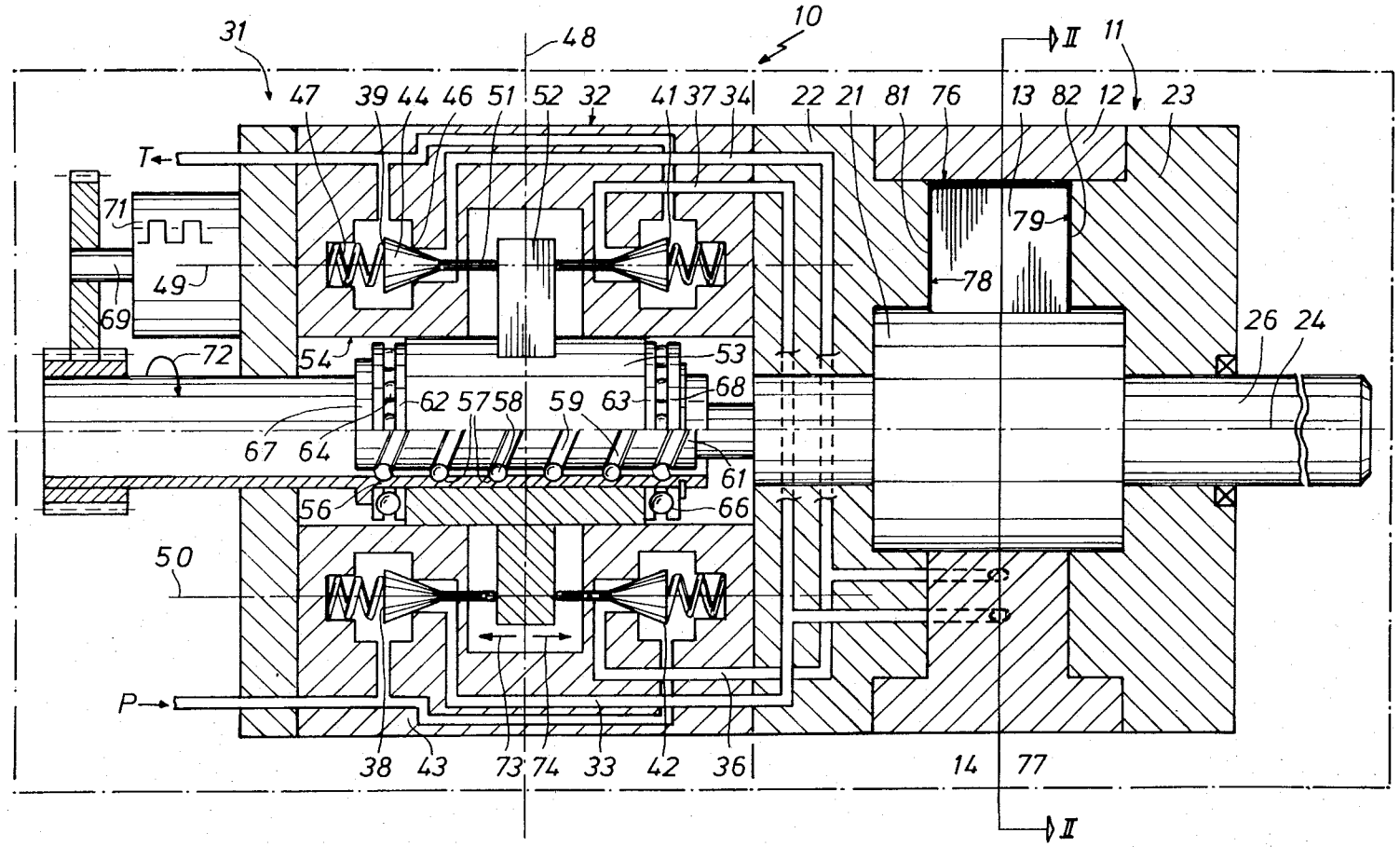
FIG. 1 is a schematic longitudinal cross-sectional view of a pivot drive according to the invention.
Figure 2:
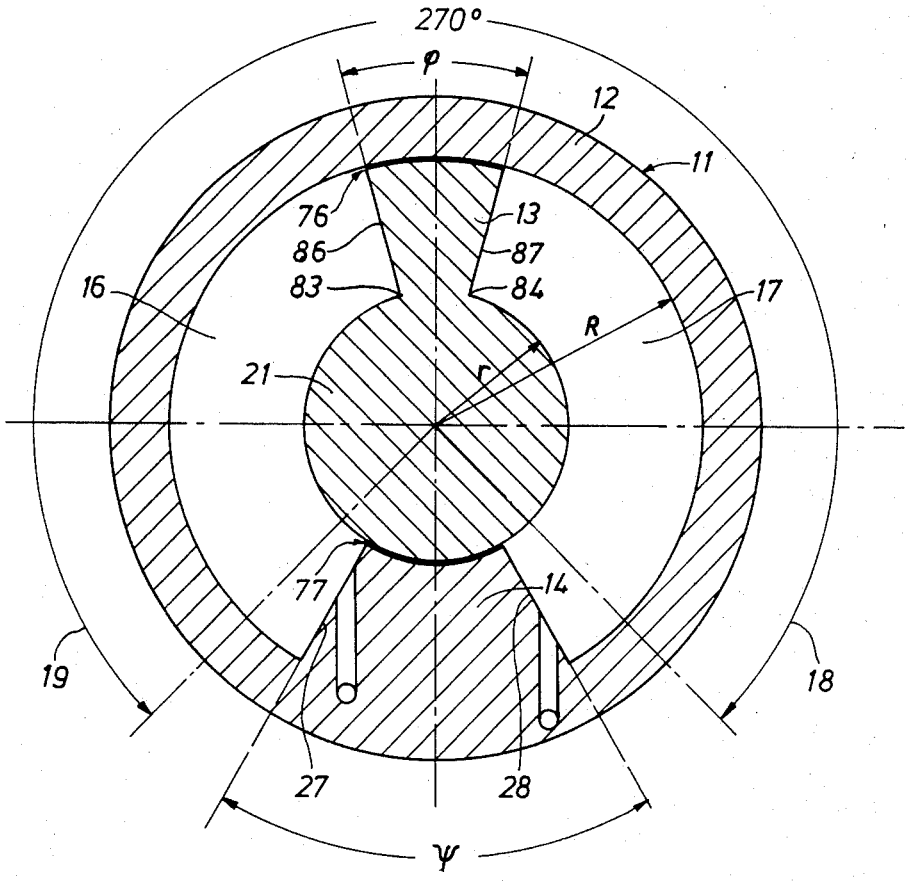
FIG. 2 is a cross-sectional view taken along the line II—II in FIG. 1.

Referring now to the drawings wherein like reference numerals are used throughout the various views to designate like parts and, more particularly, to FIGS. 1 and 2, according to these figures, a pivot or rotary drive generally designated by the reference numeral 10 includes a rotary-piston hydraulic cylinder generally designated by the reference numeral 11 as a drive unit disposed within a housing 12 accommodating a rotary vane 13 of sector-shaped cross section and a radial partition wall 14 of sector-shaped cross section defining two pressure chambers 16, 17. By connecting the chambers 16, 17 alternatively to the pressure outlet P of the high-pressure pump not shown in the drawing, or the tank of the hydraulic supply system, the rotary vane 13 can be driven in the direction of the two arrows 18 and 19. The rotary vane 13 is seated by a shaft 21 in the solid end plates 22 and 23 of the cylinder housing 12, to pivot about the latter's central longitudinal axis 24. The maximaum pivot angle of the rotary vane 13, measured between its possible end positions, is 270° in the embodiment shown. In order to bring the rotary vane 13 into any desired, but defined and pre-determinable angular position between the two end positions in which it abuts against the one or the other side 27 or 28 of the partition wall 14, and to hold it, if necessary, in this angular position, under the effect of a load acting against the drive shaft 26 of the rotary-piston hydraulic cylinder 11, a control system generally designated by the reference numeral 31 is provided which serves, on the one hand, for predetermining the exact value of the desired angular position of the rotary vane 13 and, on the other hand, for stabilizing this position by convenient regulation of the pressures in the two pressure chambers 16 and 17 of the rotary-piston hydraulic cylinder.

This control system comprises a follow-up control valve designed as directional control valve 4/3 and generally designated by the reference numeral 32 which is shown in FIGS. 3*a* to 3*c* in different possible operating positions.

In a first position I (FIG. 3*a*) of the valve, the one pressure chamber 16 of the rotary-piston hydraulic cylinder 11 is connected to the high-pressure end of the pump through the flow path of the follow-up control valve 32 represented by the arrow 33, while the flow path of the follow-up control valve 32, represented by the arrow 34, connects the other pressure chamber 17 to the tank of the hydraulic pressure-supply system of which the other parts are not shown in the drawing. The rotary piston 13 of the hydraulic cylinder 11 is in this case loaded in the sense of rotation indicated by the arrow 18. In the position of the follow-up control valve shown in FIG. 3*b* and designated 0, both pressure chambers 16 and 17 of the rotary-piston hydraulic cylinder 11 are blocked against the pump and/or the tank of the hydraulic pressure-supply system, and the rotary vane 13 remains fixed in the angular position occupied at the moment, at least as far as leakage losses are excluded or can be neglected.

In the second operative position of the follow-up control valve 32 shown in FIG. 3*c* and designated II, the pressure chamber 17 of the rotary-piston hydraulic cylinder 11 is connected to the pressure outlet of the pump through the flow path of the valve 32 represented by the arrow 36, while the flow path of the follow-up control valve 32 represented by the arrow 37 connects the other pressure chamber 16 of the rotary-piston hydraulic cylinder 11 to the tank of the hydraulic pressure-supply system. The rotary vane 13 is in this case loaded in the sense of rotation indicated by the arrow 19.

The functions of the follow-up control valve 32 described above are implemented by four seat valves 38 and 39, 41 and 42 accommodated in the arrangement shown in FIG. 1 in a common housing 43.

Each of the seat valves 38, 39, 41 and 42 has a valve body 44 substantially in the form of a truncated cone, and an annular valve seat 46 fixed to the housing. Prestressed spiral pressure springs 47 urge the said valve bodies 44 into the blocking position of the said valves 38, 39, 41 and 42. The valves 38, 39, 41 and 42 are symmetrical relative to the transverse centre plane 48 of the housing 43 of the follow-up control valve 32 extending at a right angle to the central axis 24 of the pivot drive 10. The valve bodies 44 of the valves 38, 42 and 39, 41, respectively, which are arranged opposite each other relative to the said transverse center plane 48, are guided for displacement along axes 49 and 50, respectively, extending in parallel to the longitudinal axis 24 of the pivot drive 10.

In the blocked position of the follow-up control valve 32 which corresponds to the 0 position shown in FIG. 3*b*, all four seat valves 38, 39, 41, 42 are closed and each of the valve bodies 44 is supported through a pin 51 on an actuating member 52 in the form of a radial flange which is guided for reciprocating displacement in the housing 43 in the direction of the longitudinal axis 24. The actuating member 52 is fixed on a tubular sleeve 53 guided for reciprocating displacement in a central bore 54 of the housing block 43 of the follow-up control valve 32, in the direction of the central axis 24. The sleeve 53 comprises an elongated tube-shaped rotatable spindle nut 56 whose thread grooves are in engagement, through revolving balls 58, with the thread 59 of a spindle 61 which forms the axial extension of, and is fixed to, the shaft 21 of the rotary vane 13 of the rotary-piston hydraulic cylinder 11.

In case that contrary to the arrangement shown, it is the housing 11 of the hydraulic motor instead of the rotary vane 13 which constitutes the rotating part of the drive unit, the housing 11 is fixed to the spindle 61 while the vane is rigidly connected to the housing 43 of the follow-up control valve 32.

The sleeve 53 carrying the actuating member 52 extends between the inner races 62 and 63 of thrust ball bearings 64 and 66 whose outer races 67 and 68 are fixed against displacement and rotation on the spindle nut 56, in the arrangement shown in FIG. 1. So, the sleeve 53 and/or the actuating member 52 can follow any axial displacements of the spindle nut 56 resulting from a rotary movement of the latter or of the spindle 61, but does not follow itself the rotary movements performed by the spindle nut 56.

The spindle nut 56 is coupled, either directly or as shown through a suitable gearing, in positive locking relationship, to the power take-off shaft 69 of a stepping motor 71 which is electrically controlled in a convenient manner to rotate the spindle nut by defined, predeterminable angular steps. Now, when the spindle nut 56 is rotated by a defined angle $\phi_R$ in clockwise direction in the direction of the arrow 72, this initially causes the actuating member 52 to be axially displaced in the direction indicated by arrow 73. As a result thereof, the two seat valves 38 and 39 arranged in FIG. 1 in the left-hand portion of the valve housing 32 open, while the seat valves 41 and 42 arranged in the right-hand portion of the valve housing 32 remain closed. The follow-up control valve 32 is now in its first operative position I shown in FIG. 3*a* in which the one pressure chamber 16 of the rotary-piston hydraulic cylinder 11 is connected through the flow path 33 with the high-pressure outlet of the pump, while the other pressure chamber 17 of the rotary-piston hydraulic cylinder 11 is connected to the tank of the hydraulic pressure-supply system. The rotary vane 13 of the rotary-piston hydraulic cylinder 11 now rotates in clockwise direction in the direction of the arrow 18 (FIG. 3*a*) so that due to the mechanical feedback or countercoupling provided by the spindle drive 57, 61, the actuating member 52 will resume its neutral position illustrated in FIG. 1 exactly at the moment when the pivot angle of the rotary vane 13 corresponds to the angle $\phi_R$ through which the spindle nut 56 was rotated by the stepping motor 71. From the above it results that, by pre-setting a given rotary angle for the spindle nut 56 by means of the stepping motor 71, one pre-sets the nominal value of the pivot angle of the pivot drive 10. Now, when the rotary vane 13 continues, for example under the effect of a load acting upon the power take-off shaft 26 of the rotary-piston hydraulic cylinder 11, to rotate in clockwise direction after the rotary vane 13 has reached its neutral position (FIG. 3*b*) corresponding to the desired rotary position of the follow-up control valve 32, the actuating member 52 will, due to the mechanical coupling provided by the spindle drive 56, 61, move together with the rotary vane 13 in the direction indicated by arrow 74, whereby the seat valves 41 and 42 open and the follow-up control valve 32 assumes the functional position shown in FIG. 3*c* in which the rotary vane 13 is loaded in the opposite sense of rotation represented by arrow 19. The return motion of the rotary vane 13 caused thereby ends as soon as the actuating member 52 of the follow-up control valve 32 assumes again its neutral position shown in FIG. 1 and/or FIG. 3*b*.

Insofar, the follow-up control valve 32 acts as mechanohydraulic analog control which provides effective disturbance control regardless of the type of the disturbance variables provoking a deviation of the rotary position of the rotary vane 13 from its desired position. Due to the direct feedback of the position of the rotary vane 13 to the position of the actuating member 52 realized by the spindle drive 56, 61, the control frequency $f_r$ of this analog control is favorably high, typically in the range of 500 $s^{-1}$ and under particularly favourable conditions even much higher.

In order to give a pivot drive in accordance with the inventions, e.g. the pivot drive 10 of FIG. 1, the favorable properties envisaged by the invention, i.e. a high degree of holding accuracy of a pre-determined angular position of the rotary vane 13 and a high degree of freeness from wear and friction of the rotary-piston hydraulic cylinder 11, while still achieving a simple construction of the latter, the gap widths between the rotating and the fixed parts, namely, in the present case the rotary vane 13 with its shaft 21 and the housing 12, have been selected to keep the demands on accuracy and production expense connected with the rotary-piston hydraulic cylinder 11 low while ensuring on the other hand that a disturbance variable in the form of the leakage loss $Q_L$ can be maintained by the control means 31 within the limit of an acceptable positioning error $\delta\Phi$.

If one assumes realistically that such a leakage loss $Q_L$ is substantially determined by the volume of that hydraulic fluid which passes from the high-pressure chamber to the chamber connected with the tank when the rotary-piston hydraulic cylinder 11 is in operation, the relation given in the case of the rotary-piston hydraulic cylinder 11 according to FIGS. 3a–3b can be expressed, with good approximation, by the following formula:

$$Q_L = \frac{\Delta p}{l2\,\eta}\left[\frac{b_1\,h_1^3}{l_1} + \frac{b_1\,h_2^3}{l_2} + \frac{2\,(R-r)\,h_3^3}{(l_1+l_3)/2}\right] \quad (1)$$

wherein $\eta$ is the viscosity of the hydraulic fluid;

$b_1$ is the width of the curved gaps 76 and 77 between the rotary vane 13 and the cylinder housing 12 or between the shaft 21 of the rotary vane and the partition wall 14 of the housing, measured in the direction of the longitudinal axis 24;

$h_1$ and $h_2$ are the clear widths of the gaps 76 and 77, measured in the radial direction;

$l_1$ and $l_2$ are the lengths of the gaps 76 and 77, measured in the circumferential direction;

R is the inner radius of the cylinder housing 12;

r is the radius of the shaft 21 or (R−r) is the width of the radial gaps 78 and 79 between the end walls 81 and 82 of the cylinder housing and the rotary vane 13, measured in the radial direction;

$h_3$ is the clear width of these radial gaps 78 and 79, measured in the axial direction and assumed to be equal for both gaps; and $l_3$ is the arc length of the peripheral circle of the shaft, measured between the base edges 83 and 84 extending in the axial direction, which means that $(l_1+l_2)/2$ is the mean value of the length of the radial gaps 78 and 79, measured in the direction of rotation. If one assumes realistically that the gap widths $h_1$, $h_2$ and $h_3$ have all the same value h and that the gap lengths $l_1$ and $l_2$ of the gaps 76 and 77 between the rotary vane 13 and the cylinder housing 12 or the vane shaft 21 and the partition wall 14, measured in the sense of rotation, may have the value l the relation represented by formula (1) is simplified as follows:

$$Q_L = \frac{\Delta p\cdot h^3}{l2\,\eta}\left[\frac{2\,b_1}{L} + \frac{2\,(R-r)}{(L+l_3)/2}\right] \quad (2)$$

If one further assumes realistically that the maximum pivot angle of the rotary vane 13 is 270°, it follows that the sector angle $\phi$ formed between the outer surfaces 86 and 87 or the rotary vane 13 extending in radial planes of the rotary-piston hydraulic cylinder 11 is 30° and the sector angle $\chi$ formed between the outer surfaces 27 and 28 of the partition wall 14 extending in radial planes of the rotary-piston hydraulic cylinder 11 is 60°.

In the example chosen here for a demonstration, the sensitivity a of the rotary angle is expressed by the formula:

$$a = \frac{270}{V_z}\ [\text{grad cm}^{-3}] \quad (3)$$

wherein $V_Z$ is the total volume of the two pressure chambers 16 and 17.

In the presence of a leakage flow defined by the formulas (1) and (2), the angular deviation $\Delta\Phi$ from a pre-determined desired position would accordingly be defined by the following formula:

$$\Delta\Phi = Q_L\cdot a\ \text{grad sec}^{-1} \quad (4)$$

In the combination of rotary-piston hydraulic cylinder 11 and control means 31 provided by the invention, this deviation is levelled out with the control frequency $f_r$ of the said control means 31, so that in operation the following relation is obtained for the positioning error $\delta\Phi$:

$$\delta\phi = \frac{\Delta\phi}{f_r} = \frac{Q_L\cdot a}{f_r} \quad (5)$$

Considering formula (2) which is applicable to the particular example described here, it follows that $$\delta\phi = \frac{\Delta p\cdot h^3\cdot G\cdot a}{12\ f_r} \quad (6)$$

wherein G represents the geometry factor put in formula (2) into square brackets, which reflects the influence of the length and width of the gap 76 to 79 on the leakage loss $Q_L$.

Now, it is a feature of the pivot drive 10 of the invention that with a given positioning accuracy $\delta\Phi$, the gap width is selected according to the following formula:

$$h = \sqrt[3]{\frac{\delta\phi\cdot l2\cdot\eta\cdot f_r}{\Delta p\cdot G\cdot a}} \quad (7)$$

For a rotary-piston hydraulic cylinder 11 having the following design dimensions:

| | |
|---|---|
| Total volume of the pressure chambers 16 and 17: | 40.5 $cm^3$, |
| Inner diameter of the cylinder housing 12, | 3.44 cm, and |
| Vane shaft diameter: | 3.44 cm. |

The geometry factor G obtained in accordance with formula (2) is 4.7. If one assumes that the control frequency $f_r$ or the control means 31 is 500 $s^{-1}$, the viscosity $\eta$ of the hydraulic oil is $0.22\cdot10^{-6}$ bar s and the positioning error $\delta\Phi$ is not greater than 0.5°, the following value is obtained from formula (7) for the gap width: $h=0.006$ cm.

Such great gap widths not only facilitate the production of the rotary-piston hydraulic cylinder 11, but make it also practically free from friction losses as the rotary vane 13 is lubricated all around by the leak oil flowing through the gaps 76 to 79.

If in a rotary-piston hydraulic cylinder having the dimensions set forth above the gap width is selected to be 0.05 cm, i.e. a little smaller than the gap width h maximally admissible according to formula (7), the leakage loss amounts to approx. 22 $cm^3\ s^{-1}$, which corresponds to about half the total volume of the rotary-piston hydraulic cylinder 11.

The greater the size of the rotary-piston hydraulic cylinder under the secondary conditions set forth above with respect to the gap lengths and widths—the widths should be substantially identical for all gaps to make the loaded surfaces of the rotary vane 13 as large as possible for a given total width of the gaps—the greater may be the gap width h. If one applies the formula (7) to an assumed case in which the sum of all gap widths is 3 cm, a positioning accuracy of 0.5° can be achieved already if the gaps have a width of about 0.01 cm if the control frequency of the control means 31 is again 500 $s^{-1}$.

The pivot drive of the invention is excellently suited for all those applications in which high wear-resistance, a high degree of maintenance-freeness and great positioning accuracy are demanded.

What we claim is:

1. A hydraulic pivot drive having a rotary-piston hydraulic cylinder comprising at least two pressure chambers defined by a vane and a radial wall of a cylinder housing and which can be alternatively connected to high-pressure and low-pressure sides of a hydraulic pressure supply system characterized in that control means are provided for leveling out a leak oil loss encountered in a defined rotary position of the vane, a width of gaps remaining between the vane and one of a wall of the cylinder housing or a shaft of the pivot drive and radial partition wall of the cylinder housing are determined in accordance with the following relationship:

$$h = 3\sqrt{\frac{\delta\Phi 12\eta f_r}{\Delta p\ Ga}},$$

wherein:

$\delta\Phi$ is an admissible deviation of the rotary vane from a predetermined desired position, measured in angular degrees, $\eta$ is a viscosity of the hydraulic fluid, $f_r$ is a control frequency of the control means, $\rho$ is a difference of the pressures existing in the pressure chambers of the rotary-piston hydraulic cylinder required for maintaining a defined rotary position of the rotary vane, G is a geometry factor which considers the gap lengths and widths, and a is a sensitivity of the control means determined by a relationship between the maximum pivot angle and a total volume of the pressure chambers, said control means includes a mechano-hydraulic analog controller comprising a follow-up control valve having a spindle drive means for presetting a nominal value and a feedback of the actual value, and in that the nominal value of the pivot angle of the vane can be adjusted by rotating a spindle nut of the spindle drive means by a stepping motor means, and in that the control frequency of the control means is at least 500 $s^{-1}$, the vane and the partition wall of the housing have a sector-shaped cross-section with a sector angle of 30° and 60°, respectively, a diameter of the vane shaft is equal to half a clear diameter of the cylinder housing, a radial and axial extension of the vane are in a range of substantially 18 to 20 mm, and a width of the axially and radially extending gaps between the housing and the vane are identical and substantially equal to 0.05 mm.

* * * * *